US011124849B2

(12) United States Patent
Amano et al.

(10) Patent No.: US 11,124,849 B2
(45) Date of Patent: Sep. 21, 2021

(54) METHOD FOR OPERATING CONVERTER

(71) Applicant: JFE STEEL CORPORATION, Tokyo (JP)

(72) Inventors: Shota Amano, Tokyo (JP); Yukio Takahashi, Tokyo (JP); Naoki Kikuchi, Tokyo (JP); Yuji Miki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 27 days.

(21) Appl. No.: 16/611,674

(22) PCT Filed: May 7, 2018

(86) PCT No.: PCT/JP2018/017585
§ 371 (c)(1),
(2) Date: Nov. 7, 2019

(87) PCT Pub. No.: WO2018/207718
PCT Pub. Date: Nov. 15, 2018

(65) Prior Publication Data

US 2020/0157645 A1 May 21, 2020

(30) Foreign Application Priority Data

May 8, 2017 (JP) ..... JP2017-092258

(51) Int. Cl.
*C21C 5/32* (2006.01)
*C21C 5/46* (2006.01)
*C21C 5/52* (2006.01)

(52) U.S. Cl.
CPC ..... *C21C 5/32* (2013.01); *C21C 5/4606* (2013.01); *C21C 5/5217* (2013.01)

(58) Field of Classification Search
CPC ..... C21C 5/32; C21C 5/4606; C21C 5/5217
See application file for complete search history.

(56) References Cited

U.S. PATENT DOCUMENTS 4,749,171 A 6/1988 Arima et al.

FOREIGN PATENT DOCUMENTS

CN 101638707 A 2/2010
CN 102399933 A 4/2012
(Continued)

OTHER PUBLICATIONS

JP-2017057469-A, Amano Shota; Kikuchi Naoki; Kubota Tomoyoshi; Miki Yuji; Takahashi Yukio; Tawa Satonori, English Translation from EPO, 2017 (Year: 2017).*
(Continued)

*Primary Examiner* — Anthony J Zimmer
*Assistant Examiner* — Jacob James Gusewelle
(74) *Attorney, Agent, or Firm* — Oliff PLC

(57) ABSTRACT

When the decarburization refining of molten iron is performed by top-blowing oxygen gas from the top blowing lance, the oscillation of molten iron, a bubble burst, and spitting due to the bubble burst are suppressed. A refining method for a converter includes decarburizing molten iron in the converter with a top blowing lance having Laval nozzles disposed at the lower end thereof by blowing oxygen gas on the surface of the molten iron in the converter through the Laval nozzles, in which one or both of an oxygen feeding
(Continued)

rate from the top blowing lance and lance height LH are adjusted in such a manner that an oxygen accumulation index S(F) is 40 or less.

2 Claims, 2 Drawing Sheets

(56) References Cited

FOREIGN PATENT DOCUMENTS

| | | | | |
|---|---|---|---|---|
| CN | 102732668 | A | | 10/2012 |
| CN | 103890199 | A | | 6/2014 |
| CN | 105793444 | A | | 7/2016 |
| EP | 2752497 | A1 | | 7/2014 |
| JP | S55-113824 | A | | 9/1980 |
| JP | 2000119725 | A | | 4/2000 |
| JP | 2000-303114 | A | | 10/2000 |
| JP | 2000309816 | A | | 11/2000 |
| JP | 2004115857 | A | | 4/2004 |
| JP | 2011084789 | A | | 4/2011 |
| JP | 2013-108153 | A | | 6/2013 |
| JP | 2017-57468 | A | | 3/2017 |
| JP | 2017-57469 | A | | 3/2017 |
| JP | 2017057469 | A | * | 3/2017 |
| SU | 767214 | A1 | | 9/1980 |
| SU | 1046290 | A1 | | 10/1983 |
| SU | 1470774 | A1 | | 4/1989 |
| SU | 1539211 | A1 | | 1/1990 |
| TW | 201525146 | A | | 7/2015 |

OTHER PUBLICATIONS

Tate et al; "Observations of Decarburization of Liquid Metal;" pp. 488-490 (1970).

Michihiko Shimada; "On the Reacting Interfacial Area of Fire Point in Basic Oxygen Furnace;" pp. 1764-1774; (1971).

Sogabe et al; "Response Analysis on Sloshing of Liquid in a Cylindrical Storage; Basic Equation and Response to Sinusoidal Input" pp. 119-122; (1974).

Kojima et al; "Quantitative Evaluation of Vessel Vibration on the Top and Bottom Blown Converter;" Kawasaki Steel GIHO; vol. 19; No. 1; (7 pages); (1987).

Jun. 19, 2018 International Search Report issued in International Patent Application No. PCT/JP2018/017585.

Jun. 19, 2018 Written Opinion issued in International Patent Application No. PCT/JP2018/017585.

Apr. 21, 2020 Office Action issued in Russian Patent Application No. 2019135765.

Oct. 31, 2019 Extended European Search Report issued in European Patent Application No. 18798026.3.

Jan. 8, 2019 Office Action issued in Taiwanese Patent Application No. 107115516.

Dec. 24, 2020 Office Action issued in Chinese Patent Application No. 201880030354.7.

* cited by examiner

METHOD FOR OPERATING CONVERTER

TECHNICAL FIELD

This application relates to a method for operating a converter by blowing oxygen gas on hot metal through multiple Laval nozzles provided on a top blowing lance to produce molten steel from molten iron while preventing the spouting of the hot metal to the outside of the converter. The term "molten iron" used here refers to hot metal or molten steel. When hot metal and molten steel are clearly distinguishable from each other, "hot metal" or "molten steel" is used.

BACKGROUND

In decarburization refining with converters, from the viewpoint of improving the productivity of converters, operations are performed at large amounts of oxygen gas supplied per unit time (also referred to as an "oxygen feeding rate"). However, larger amounts of oxygen gas supplied per unit time results in increases in the amounts of iron scattered from converters to the outside in the form of, for example, dust and increases in the amounts of iron adhering and deposited on walls of converters and near the throats of converters. These iron losses will eventually be recovered and used again as iron sources. However, an increase in this amount leads to an increase in cost required to recover the dust and to remove iron adhering near the throat of the converter and leads to decreases in the operating rates of converters. Thus, it is one of the important issues to be solved.

Regarding the generation and suppression of dust during decarburization refining in converters, many studies have been conducted in the past. As a result, it is known that the generation mechanism of dust is roughly classified into the following two mechanisms and that the amount of dust generated and the ratio of dust generated by each generation mechanism change with the progress of blowing.

[1] Dust is generated by a bubble burst (for example, spitting (scattering of metal) or scattering of granular iron due to bubbles separated from molten metal).

[2] Dust is generated by fumes (evaporation of iron atoms).

It is known that a decarburization reaction rate in using top-blown oxygen from a top blowing lance is limited by oxygen supply in the period until a carbon concentration in molten iron reaches a critical carbon concentration and is limited by the movement (diffusion) of carbon in molten iron at a carbon concentration of less than the critical carbon concentration. Non Patent Literature 1 states that the decarburization rate based on continuous analysis of exhaust gas is not constant but varies even for the rate-limiting period governed by oxygen supply. Direct observation of the surface of hot metal in a small melting furnace during decarburization refining revealed that the variations in the decarburization rate for the rate-limiting period governed by oxygen supply generate large bubbles from the surface of the hot metal. It is thus believed that the variations in decarburization rate are caused by the expansion of a reaction area due to the transition from a surface reaction to a reaction in a bath.

The decarburization reaction using top-blown oxygen is known to proceed mainly in the collision interface between an oxygen jet and molten iron, i.e., a "cavity" called "hot spot". Non Patent Literature 2 states that as represented by Formula (4), an equivalent interfacial area A* considering the influence of drops generated on the surface of hot metal in addition to the surface area $A_p$ of the geometric cavity is defined as the area of the hot spot and that as represented by Formula (5), oxygen efficiency for decarburization decreases with increasing oxygen load $F_g$, which is the ratio of the flow rate of top-blown oxygen $F_{o2}$ to the equivalent interfacial area A*.

[Math. 1]

$$A^* \equiv A_p \times \left(\frac{\kappa \times I}{\sigma \times d_c}\right)^{0.2} \tag{4}$$

$$F_g = \frac{F_{o2}}{A^*} \tag{5}$$

In Formula (4), $d_c$ is the throat diameter of a Laval nozzle, I is the momentum of a top-blown oxygen jet, κ is the correction factor of the momentum I, and σ is the surface tension of molten iron.

In a refining reaction vessel such as a converter, the molten iron in the reaction vessel oscillates by top- or bottom-blown gas supply for refining and stirring and the generation of CO gas due to the decarburization reaction. When the frequency of oscillation and the natural frequency determined by the shape of the reaction vessel coincide, i.e., when they are resonated, the amplitude of the oscillation is maximized. Such a phenomenon is called "sloshing". When sloshing occurs, the amount of iron adhering and deposited on the top blowing lance and the vessel wall and near the throat of the vessel increases.

Non Patent Literature 3 describes sloshing and states that the natural frequency $f_{calc}$ of a cylindrical vessel can be analytically determined and can be calculated from Formula (6) described below using the inside diameter D of the cylindrical vessel and the depth H of hot metal. In Formula (6), g is gravitational acceleration, and k is a constant (=1.84).

[Math. 2]

$$f_{calc} = \frac{1}{2\pi}\sqrt{\frac{2k \times g}{D}\tanh\left(2k \times \frac{H}{D}\right)} \tag{6}$$

Non Patent Literature 4 states that the vibration of a converter during decarburization refining is actually measured and that the oscillation frequency of molten iron in a commercial-scale converter is about 0.3 to about 0.4 Hz. This measured value substantially matches the natural frequency of the converter calculated from equation (6).

This indicates that the sloshing phenomenon can also occur in a commercial-scale converter. When the sloshing phenomenon occurs, slopping (slag splashing) occurs easily, thus increasing the amount of iron adhering and deposited on the top blowing lance and the wall of converter and near the throat of the converter.

Patent Literature 1 describes, for the purpose of suppressing occurrences of spitting and slapping, a refining process for suppressing the occurrences of spitting and slopping in a converter operation where the amount of oxygen supplied per unit time is increased, the process including calculating a residual oxygen concentration in the converter on the basis of the amount of oxygen gas supplied to the converter, the flow rate of an exhaust gas from the converter, the composition of the exhaust gas, hot-metal components, and the amounts of auxiliary raw materials; and adjusting at least one of the amount of oxygen gas supplied, the height of the lance, and the flow rate of a bottom-blown gas in accordance with the calculated residual oxygen concentration in the converter.

CITATION LIST

Patent Literature

PTL 1: Japanese Unexamined Patent Application Publication No. 2013-108153

Non Patent Literature

NPL 1: Seisan Kenkyu (Production Research), vol. 22(1970), No. 11, p. 488

NPL 2: Tetsu-to-Hagane (Iron and Steel), vol. 57(1971), No. 12, p. 1,764

NPL 3: Seisan Kenkyu (Production Research), vol. 26(1974), No. 3, p. 119

NPL 4: Kawasaki Steel Technical Report, vol. 19(1987), No. 1, p. 1

SUMMARY

Technical Problem

In the refining process described in Patent Literature 1, signs of slopping (slag splashing) are monitored, and then action is performed. Although the slopping can be detected, a bubble burst and spitting (scattering of metal) due to the bubble burst cannot be suppressed.

The disclosed embodiments have been made in light of the foregoing circumstances. The objective of the present application is to provide a method for operating a converter when decarburization refining of molten iron is performed by blowing oxygen gas from a top blowing lance, the method suppressing the oscillation of molten iron, a bubble burst and spitting due to the bubble burst, and a decrease in iron yield.

Solution to Problem

The disclosed embodiments to solve the foregoing problems are characterized by the following:

[1] A method for operating a converter includes a refining method including decarburizing molten iron in a converter with a top blowing lance having one or more Laval nozzles disposed at the lower end thereof by blowing oxygen gas on the surface of the molten iron in the converter through the one or more Laval nozzles, in which an oxygen gas flow rate F per unit hot spot area ($Nm^3/(m^2 \times s)$) is determined by Formula (1) described below, an oxygen accumulation index S(F) in the converter is determined from the oxygen gas flow rate F and Formula (2) described below, and one or both of an oxygen feeding rate $Q_g$ from the top blowing lance and lance height LH are adjusted in such a manner that the oxygen accumulation index S(F) satisfies Formula (3) described below,

[Math. 3]

$$F = \frac{\left(\frac{Q_g}{n}\right)^{1.2}}{\frac{\pi}{6} \times r \times \left[(r^2 + 4L)^{\frac{3}{2}} - r^3\right]} \times \left(\frac{4.8586\ P_0^{0.112} \times d_c^{-0.44} \times v_{gc}}{1630}\right)^{0.2} \quad (1)$$

$$S(F) = \alpha\Sigma\left(\frac{1}{F_0} - \frac{1}{F}\right)\Delta t \quad (2)$$

$$S(F) \leq 40 \quad (3)$$

where in Formula (1), n is the number (-) of the Laval nozzles disposed at the lower end of the top blowing lance, $d_c$ is the throat diameter (mm) of each of the one or more Laval nozzles, $Q_g$ is the oxygen feeding rate ($Nm^3/s$) from the top blowing lance, $P_0$ is the supply pressure (Pa) of the oxygen gas to the one or more Laval nozzles, $v_{gc}$ is an oxygen gas flow velocity calculated from the lance height LH (m) at a collision surface of a molten iron surface and is the oxygen gas flow velocity (m/s) along the central axis of each of the one or more Laval nozzles, r is the radius (mm) of a cavity formed by collision of the oxygen gas with the molten iron surface, and L is the depth (mm) of the cavity, and where in Formula (2), $\alpha$ is a constant ($(m^2 \times s)/Nm^3$), $F_0$ is a constant ($Nm^3/(m^2 \times s)$), and $\Delta t$ is a data collection time interval (s).

[2] In the method for operating a converter described in [1], the actual value of the oxygen accumulation index S(F) calculated from Formula (2) and the amount of unidentified oxygen are monitored during blowing to determine the constant $\alpha$, the amount of unidentified oxygen being defined by the difference between the amount of oxygen input and the amount of oxygen output, the amount of oxygen input being defined by the total of the amount of the oxygen gas supplied from the top blowing lance and the amount of oxygen in an auxiliary raw material charged into the converter, the amount of oxygen output being defined by the total of amounts of oxygen present as CO gas, $CO_2$ gas, and oxygen gas in an exhaust gas from the converter and the amount of oxygen consumed by a desiliconization reaction and present as $SiO_2$ in the converter.

Advantageous Effects

According to the disclosed embodiments, because the oxygen accumulation index S(F) defined by Formula (2) as a function of the oxygen feeding rate $Q_g$ from the top blowing lance and the lance height LH is controlled within a predetermined range, it is possible to suppress the oscillation of molten iron in the converter and reduce the amount of iron adhering and deposited on the top blowing lance and the wall of the converter and near the throat of the converter.

DETAILED DESCRIPTION

Figure 1:
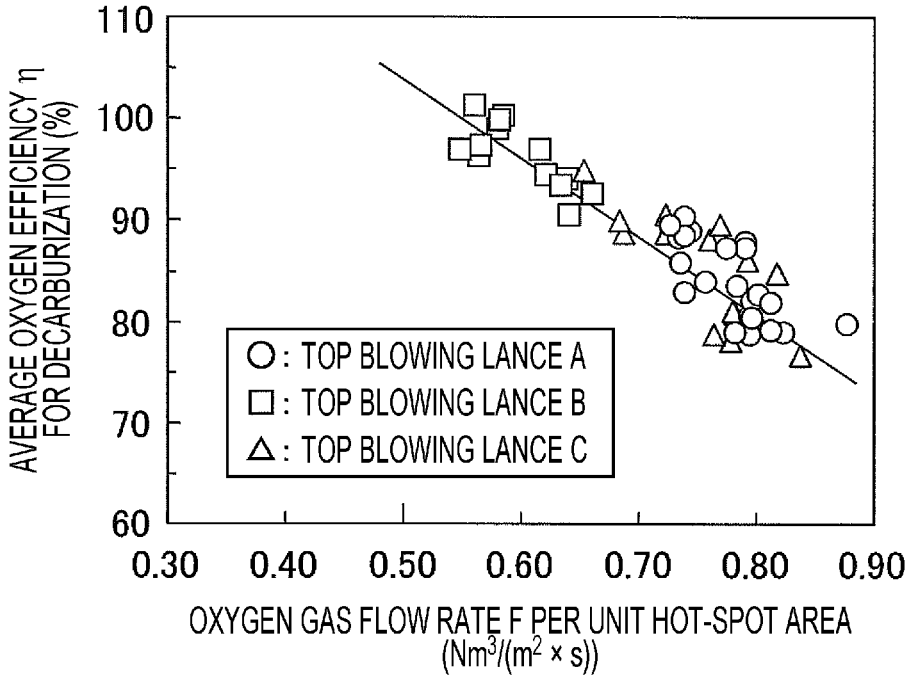
FIG. 1 is a graph illustrating the relationship between the average oxygen efficiency $\eta$ for decarburization and the oxygen gas flow rate F per unit hot spot area calculated from Formula (1).

The present application will be described below through the use of disclosed embodiments. First, the circumstances leading to the completion of the disclosed embodiments will be described.

The inventors have conducted studies on the influence of the lance height LH of a top blowing lance on the amount of metal adhering to the wall of a converter and the top blowing lance when hot metal is subjected to decarburization refining with the 300-ton-capacity converter by top-blowing oxygen gas (industrial pure oxygen gas) on hot metal in the converter, the converter being configured to enable oxygen gas to be blown from the top blowing lance and configured to enable a stirring gas to be simultaneously blown through a bottom blowing tuyere in the bottom section of the converter. Argon gas was used as the bottom-blown stirring gas. The "lance height LH" refers to a distance (m) from the tip of the top blowing lance to the surface of the hot metal when the hot metal in the converter is in a static state.

In an experiment, three types of top blowing lances (top blowing lances A, B, and C) were used as presented in Table 1. The oxygen feeding rate (the flow rate of oxygen supplied) from each of the top blowing lances was changed in the range of 750 to 1,000 $Nm^3$/min. The lance height LH was changed in the range of 2.2 to 2.8 m. Metal adhering to the throat and the hood of the converter during blowing and then dropped to the outside of the converter was recovered after the blowing and weighed to check the influence of the lance height LH and blowing conditions on the amount of adhering metal.

TABLE 1

| Type of top blowing lance | Number of main hole | Shape of main hole | Throat diameter of main hole (mm) | Exit diameter (mm) | Nozzle tilt angle of main hole (°) |
|---|---|---|---|---|---|
| Top blowing lance A | 4 | Laval nozzle | 76.0 | 87.0 | 17 |
| Top blowing lance B | 5 | Laval nozzle | 57.0 | 67.2 | 15 |
| Top blowing lance C | 5 | Laval nozzle | 65.0 | 75.3 | 15 |

In a test, an accelerometer was attached to the tilt shaft of the converter, and the acceleration in the tilt shaft direction was measured during blowing. The obtained acceleration signal was taken into an analyzer, recorded, and subjected to fast Fourier transform to perform frequency analysis of vessel vibration.

In the test, the supply of oxygen gas from each top blowing lance was started when the carbon concentration in hot metal was 4.0% by mass, and the supply of oxygen gas was stopped when the carbon concentration in molten steel was 0.05% by mass.

In the decarburization refining of hot metal by top-blowing oxygen gas, an oxygen gas flow rate F per unit hot spot area ($Nm^3/(m^2 \times s)$) is represented by Formula (1) below. The oxygen gas flow rate F per unit hot spot area is the average of the flow rates of colliding oxygen gas per unit area at multiple hot spots, which are portions of the surface of hot metal colliding with top-blown oxygen gas in the converter, for a period of the decarburization refining.

[Math. 4]

$$F = \frac{\left(\frac{Q_g}{n}\right)^{1.2}}{\frac{\pi}{6} \times r \times \left[(r^2 + 4L)^{\frac{3}{2}} - r^3\right]} \times \left(\frac{4.8586\, P_0^{0.112} \times d_c^{-0.44} \times v_{gc}}{1630}\right)^{0.2} \quad (1)$$

In Formula (1), n is the number (-) of the Laval nozzles disposed at the lower end of the top blowing lance. $d_c$ is the throat diameter (mm) of each of the Laval nozzles. $Q_g$ is the oxygen feeding rate ($Nm^3$/s) from the top blowing lance. $P_0$ is the supply pressure (Pa) of the oxygen gas to the Laval nozzles of the top blowing lance.

$v_{gc}$ is an oxygen gas flow velocity calculated from the lance height LH (m) at a collision surface of a hot metal surface and is the oxygen gas flow velocity (m/s) along the central axis of each of the Laval nozzles. r is the radius (mm) of a cavity formed by collision of the oxygen gas with the hot metal surface. L is the depth (mm) of the cavity.

Methods for calculating the oxygen gas flow velocity $v_{gc}$ (m/s), the diameter r (mm) of the cavity, and the depth L (mm) of the cavity will be described below.

Assuming that a gas flow in the Laval nozzle is adiabatic change, the discharge flow velocity $v_{g0}$ (m/s) of a gas ejected from the Laval nozzle is represented by Formula (7). In Formula (7), g is the gravitational acceleration ($m/s^2$). $p_c$ is a pressure (static pressure) (Pa) at the throat of the Laval nozzle. $p_e$ is a pressure (static pressure) (Pa) at the nozzle exit of the Laval nozzle. $v_c$ is a specific volume ($m^3$/kg) in the throat of the Laval nozzle. $v_e$ is a specific volume ($m^3$/kg) in the exit of the Laval nozzle. K is an isentropic expansion factor.

[Math. 5]

$$v_{g0}^2 = 2 \times g \times \frac{K}{K-1} \times (p_c \times v_c - p_e \times v_e) \quad (7)$$

$v_{gc}$ that is the oxygen gas flow velocity along the central axis of the Laval nozzle after ejection from the Laval nozzle is known to be determined as a function of the distance from the nozzle to the surface of the hot metal. Thus, considering region length $x_c$ (m) called a potential core formed directly below the exit of the Laval nozzle, the oxygen gas flow velocity $v_{gc}$ is represented by Formula (8) below. In Formula (8), β and γ are constants. Accordingly, in the case where $v_{g0}$, LH, and $x_c$ are known, the oxygen gas flow velocity $v_{gc}$ can be calculated using Formula (8) below.

[Math. 6]

$$v_{gc} = \beta \times v_{g0} \times \left(\frac{LH - x_c}{d_c}\right)^{\gamma} \quad (8)$$

The depth L (mm) of the cavity formed on the molten iron surface with which the jet collides is represented by Formula (9) below. In Formula (9), ε is a dimensionless constant and is a value in the range of 0.5 to 1.0. In this embodiment, the depth L of the cavity is calculated by setting ε to 1.0.

[Math. 7]

$$L = 63.0 \times \left(\varepsilon \times \frac{Q_g}{n \times d_c}\right)^{\frac{2}{3}} \times e^{\left(-0.78 \times \frac{LH}{63.0 \times \left(\varepsilon \times \frac{Q_g}{n \times d_c}\right)^{\frac{2}{3}}}\right)} \quad (9)$$

The diameter r (mm) of the cavity formed on the molten iron surface with which the jet collides is represented by Formula (10) below. In Formula (10), $\theta_s$ is a jet spread angle (°).

[Math. 8]

$$r = LH \times \tan(\theta_s) \quad (10)$$

FIG. 1 is a graph illustrating the relationship between the average oxygen efficiency η (%) for decarburization during blowing when decarburization is performed in such a manner that the carbon concentration is changed from 3% by mass to 1% by mass during the blowing and the oxygen gas flow rate F per unit hot spot area ($Nm^3/(m^2 \times s)$) calculated from Formula (1). The average oxygen efficiency η (%) for decarburization was defined by Formula (11) using an exhaust gas flow rate $Q_{offgas}$ ($Nm^3/s$), a CO concentration in the exhaust gas ($C_{CO}$; % by volume), and a $CO_2$ concentration in the exhaust gas ($C_{CO2}$; % by volume).

[Math. 9]

$$\eta = \frac{11.2}{22.4} \times (C_{CO} + C_{CO2}) \times \frac{Q_{offgas}}{Q_g} \times 100 \quad (11)$$

As apparent from FIG. 1, the average oxygen efficiency η (%) for decarburization decreases as the oxygen gas flow rate F per unit hot spot area increases. In other words, a higher oxygen gas flow rate F per unit hot spot area results in a larger amount of oxygen accumulated in the converter.

Figure 2:
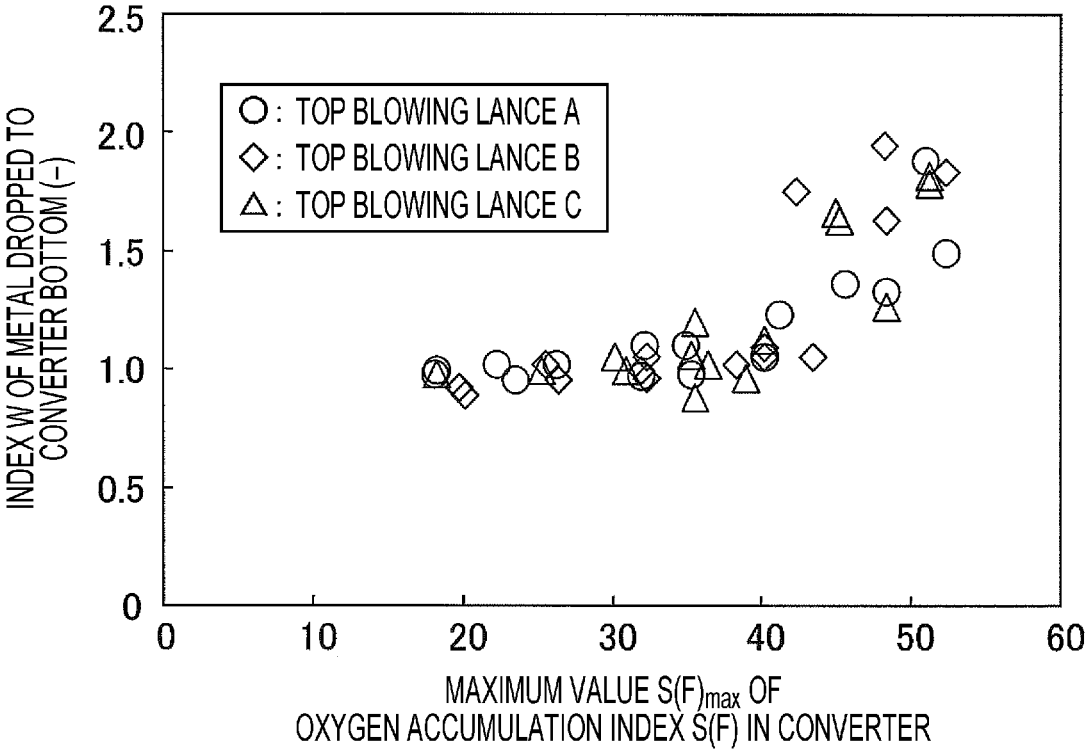
FIG. 2 is a graph illustrating the relationship between the index W of metal dropped to outside of a converter and the maximum value $S(F)_{max}$ of an oxygen accumulation index S(F) in a converter calculated from Formula (2).

FIG. 2 is a graph illustrating the relationship between the index W of metal dropped to outside of a converter and the maximum value $S(F)_{max}$ of an oxygen accumulation index S(F) in the converter during blowing. The oxygen accumulation index S(F) in the converter is defined by Formula (2) below. In Formula (2), F is the oxygen gas flow rate F per unit hot spot area calculated from Formula (1). α is a constant ($(m^2 \times s)/Nm^3$). $F_0$ is a constant ($Nm^3/(m^2 \times s)$). In this embodiment, the constant α is set to 0.07 $(m^2 \times s)/Nm^3$, and the constant $F_0$ is set to 0.60 $Nm^3/(m^2 \times s)$. The constant α is a value in the range of 0.05 to 0.10 $(m^2 \times s)/Nm^3$ in accordance with the flow rate of a bottom-blown gas per unit mass of molten steel. Δt is a data collection time interval (s) and is, for example, 1 second in this embodiment. In the case where Δt is 1 second and where the blowing time is 20 minutes, the oxygen accumulation index S(F) is calculated by calculating $(1/F_0 - 1/F)$ every 1 second, integrating this operation about 1,200 times, and multiplying the resulting value by α.

[Math. 10]

$$S(F) = \alpha \Sigma \left(\frac{1}{F_0} - \frac{1}{F}\right) \Delta t \quad (2)$$

The index W of metal dropped to outside of a converter is defined by Formula (12) below. The "Measured mass of metal dropped to outside of a converter" described in the denominator on the right-hand side of Formula (12) is the average mass of metal dropped after the completion of blowing in multiple charge tests.

[Math. 11]

$$W = \frac{\text{Measured mass of metal dropped to outside of a converter (kg)}}{\text{Average mass of metal dropped to outside of a converter in blowing at } S(F)_{max} \text{ of less than 40 (kg)}} \quad (12)$$

As apparent from FIG. 2, the index W of metal dropped to outside of the converter increases sharply when the maximum value $S(F)_{max}$ of the oxygen accumulation index S(F) in the converter is more than 40.

Figure 3:
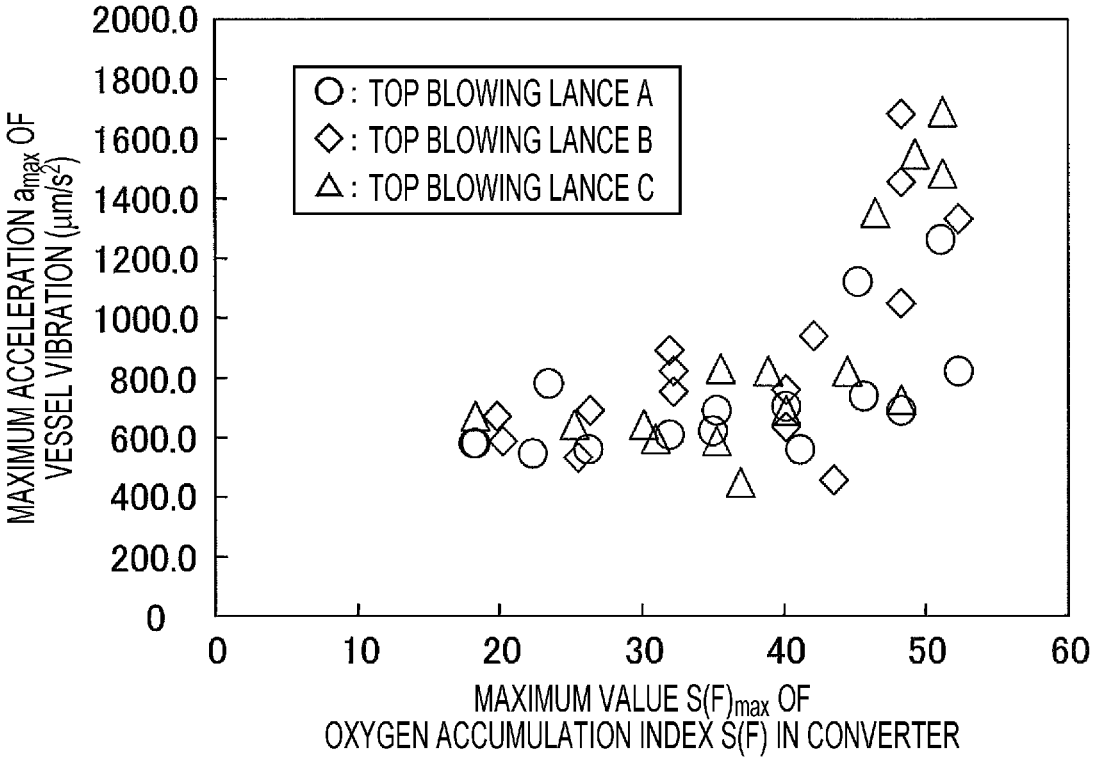
FIG. 3 is a graph illustrating the relationship between the maximum acceleration $a_{max}$ of vessel vibration and the maximum value $S(F)_{max}$ of the oxygen accumulation index S(F) calculated from Formula (2).

FIG. 3 is a graph illustrating the relationship between the maximum acceleration $a_{max}$ at a natural frequency of 0.35 Hz calculated from Formula (6) in vessel vibration during blowing and the maximum value $S(F)_{max}$ of the oxygen accumulation index S(F) in the converter.

As apparent from FIG. 3, the maximum acceleration $a_{max}$ increases as the maximum value $S(F)_{max}$ of the oxygen accumulation index S(F) in the converter during blowing increases. When the maximum value $S(F)_{max}$ is more than 40, the increment of the maximum acceleration $a_{max}$ is increased. In other words, it is found that when the maximum value $S(F)_{max}$ is more than 40, the oscillation of the hot metal can be increased.

It should be noted here that regardless of the difference in the Laval nozzles of the top blowing lance, the oxygen gas flow rate F per unit hot spot area negatively correlates with the average oxygen efficiency η for decarburization, the maximum value $S(F)_{max}$ of the oxygen accumulation index S(F) in the converter during blowing positively correlates with the index W of metal dropped to outside of the converter and the maximum acceleration $a_{max}$ of vessel vibration, and that both of the index W of metal dropped to outside of the converter and the maximum acceleration $a_{max}$ of vessel vibration are remarkably increased at a maximum value $S(F)_{max}$ of more than 40.

To suppress the oscillation of molten iron, to reduce metal adhering to the throat and the hood of the converter, and to prevent a decrease in iron yield, the results indicate that it is important to control the maximum value $S(F)_{max}$ of the oxygen accumulation index S(F) in the converter to 40 or less, i.e., to satisfy Formula (3):

$$S(F) \leq 40 \quad (3)$$

The constant α changes slightly, depending on, for example, the operation state of the vessel. Thus, at the time of implementation, the actual value of the oxygen accumulation index S(F) calculated from Formula (2) and the amount of unidentified oxygen are preferably monitored during blowing to determine the constant α on the basis of the actual value of the oxygen accumulation index S(F) and the amount of unidentified oxygen, the amount of unidentified oxygen being defined by the difference between the amount of oxygen input and the amount of oxygen output, the amount of oxygen input being defined by the total of the amount of the oxygen gas supplied from the top blowing lance and the amount of oxygen in an auxiliary raw material charged into the converter, the amount of oxygen output being defined by the total of amounts of oxygen present as CO gas, $CO_2$ gas, and oxygen gas in an exhaust gas from the converter and the amount of oxygen consumed by a desiliconization reaction and present as $SiO_2$ in the converter.

The disclosed embodiments based on the above examination results and relates to a refining method in a converter, the method including subjecting molten iron in the converter to oxidation refining such as decarburization refining with a top blowing lance having Laval nozzles disposed at the lower end thereof by blowing oxygen gas on the surface of the molten iron in the converter through the Laval nozzle, in which one or both of the oxygen feeding rate $Q_g$ from the top blowing lance and the lance height LH are adjusted in such a manner that the oxygen gas flow rate F per unit hot spot area determined by Formula (1) described above and the oxygen accumulation index S(F) in the converter determined by Formula (2) satisfy Formula (3) described above.

By adjusting one or both of the oxygen feeding rate $Q_g$ from the top blowing lance and the lance height LH in such a manner that the oxygen accumulation index S(F) satisfies Formula (3), excessive supply of oxygen to the surface of the molten iron is suppressed, subsequently excessively large CO bubbles generation is suppressed because the reaction of carbon and oxygen occurs in the molten iron, thereby suppressing a bubble burst and spitting due to the bubble burst.

As illustrated in FIG. 3, by adjusting one or both of the oxygen feeding rate $Q_g$ from the top blowing lance and the lance height LH in such a manner that the oxygen accumulation index S(F) satisfies Formula (3), the increase of the oscillation of the molten iron can be suppressed.

As described above, by implementing the method for operating a converter according to the embodiment, it is possible to suppress the oscillation of molten iron and a bubble burst and spitting due to the bubble burst. This reduces the scattering of iron to the outside of the converter, reduces cost required to recover and reuse the metal, and can suppress a decrease in the operating rate of the converter due to the removal of metal adhering and deposited on, for example, the throat of the converter.

EXAMPLES

Examples of the disclosed embodiments will be described below. Decarburization refining was performed with a 300-ton-capacity converter configured to enable oxygen gas to be blown from the top blowing lance and configured to enable a stirring gas to be blown through a bottom blowing tuyere in the bottom section of the converter (hereinafter, referred to as a "top-bottom blown converter"). As the evaluation of the scattering of iron to the outside of the converter, the index W of metal dropped to outside of a converter defined by Formula (12) was used.

The top blowing lance used in this example had four identically-shaped Laval nozzles serving as jet nozzles at its tip portion. The Laval nozzles are arranged concentrically to the axial center of the main body of the top blowing lance at regular intervals and an angle of 17° between the axial center of the main body of the top blowing lance and the central axis of each of the nozzles (hereinafter, referred to as a "nozzle tilt angle"). Each Laval nozzle had a throat diameter $d_c$ of 76.0 mm and an exit diameter $d_e$ of 87.0 mm.

Similarly, the following top blowing lances were used: a top blowing lance having five Laval nozzles, a nozzle tilt angle of 15°, a throat diameter $d_c$ of 65.0 mm, and an exit diameter $d_e$ of 78.0 mm; a top blowing lance having five Laval nozzles, a nozzle tilt angle of 15°, a throat diameter $d_c$ of 65.0 mm, and an exit diameter $d_e$ of 75.3 mm; and a top blowing lance having five Laval nozzles, a nozzle tilt angle of 15°, a throat diameter $d_c$ of 57.0 mm, and an exit diameter $d_e$ of 67.2 mm. Table 2 presents the specifications of the top blowing lances used in tests.

TABLE 2

| | Number of main hole | Throat diameter of main hole (mm) | Exit diameter of main hole (mm) | Nozzle tilt angle of main hole (°) |
|---|---|---|---|---|
| Example 1 | 4 | 76.0 | 87.0 | 17 |
| Example 2 | 5 | 65.0 | 78.0 | 15 |
| Example 3 | 5 | 65.0 | 75.3 | 15 |
| Example 4 | 5 | 57.0 | 67.2 | 15 |
| Comparative example 1 | 4 | 76.0 | 87.0 | 17 |
| Comparative example 2 | 4 | 76.0 | 87.0 | 17 |
| Comparative example 3 | 5 | 65.0 | 78.0 | 15 |
| Comparative example 4 | 5 | 65.0 | 78.0 | 15 |
| Comparative example 5 | 5 | 65.0 | 78.0 | 15 |

A method for operating a converter was as follows: After scrap iron was charged into the top-bottom blown converter, hot metal with a temperature of 1,260° C. to 1,280° C. was charged into the top-bottom blown converter. Decarburization refining was then performed by blowing argon gas or nitrogen gas serving as a stirring gas into the hot metal through the bottom blowing tuyere while oxygen gas was blown on the surface of the hot metal from the top blowing lance at an average flow rate of 2.0 $Nm^3/(hr \times t)$ until the carbon concentration of molten steel reached 0.05% by mass. The amount of scrap iron charged was adjusted in such a manner that the temperature of the molten steel was 1,650° C. at the time of the completion of the refining. Table 3 presents the composition and the temperature of the hot metal used.

TABLE 3

| Chemical composition of molten iron (% by mass) | | | | | | Temperature of molten |
|---|---|---|---|---|---|---|
| C | Si | Mn | P | S | Cr | iron (° C.) |
| 3.9-4.2 | 0.01-0.04 | 0.12-0.25 | 0.016-0.036 | 0.006-0.015 | tr | 1,260-1,280 |

Table 4 presents the oxygen feeding rate from the top blowing lance and the lance height LH. As presented in Table 4, each of the oxygen feeding rate from the top blowing lance and the lance height LH was separately set for each of sections 1, 2, and 3 in accordance with the carbon concentration in the hot metal.

TABLE 4

| | Section | Carbon concentration (% by mass) | Oxygen feeding rate ($Nm^3$/min) Section | Oxygen feeding rate ($Nm^3$/min) Average | Lance height (m) Section | Lance height (m) Average |
|---|---|---|---|---|---|---|
| Example 1 | 1 | >3.0 | 800 | 898 | 2.80 | 2.64 |
| | 2 | 3.0-0.5 | 950 | | 5.60 | |
| | 3 | <0.5 | 800 | | 2.50 | |
| Example 2 | 1 | >3.0 | 750 | 885 | 2.50 | 2.48 |
| | 2 | 3.0-0.5 | 950 | | 2.45 | |
| | 3 | <0.5 | 800 | | 2.60 | |
| Example 3 | 1 | >3.0 | 850 | 840 | 2.60 | 2.43 |
| | 2 | 3.0-0.5 | 850 | | 2.40 | |
| | 3 | <0.5 | 750 | | 2.20 | |
| Example 4 | 1 | >3.0 | 850 | 840 | 2.60 | 2.43 |
| | 2 | 3.0-0.5 | 850 | | 2.40 | |
| | 3 | <0.5 | 750 | | 2.30 | |
| Comparative example 1 | 1 | >3.0 | 850 | 883 | 2.80 | 2.64 |
| | 2 | 3.0-0.5 | 900 | | 2.55 | |
| | 3 | <0.5 | 850 | | 2.70 | |
| Comparative example 2 | 1 | >3.0 | 850 | 840 | 2.80 | 2.55 |
| | 2 | 3.0-0.5 | 850 | | 2.50 | |
| | 3 | <0.5 | 750 | | 2.30 | |
| Comparative example 3 | 1 | >3.0 | 750 | 885 | 2.60 | 2.51 |
| | 2 | 3.0-0.5 | 950 | | 2.45 | |
| | 3 | <0.5 | 800 | | 2.70 | |

TABLE 4-continued

| | Section | Carbon concentration (% by mass) | Oxygen feeding rate ($Nm^3$/min) Section | Oxygen feeding rate ($Nm^3$/min) Average | Lance height (m) Section | Lance height (m) Average |
|---|---|---|---|---|---|---|
| Comparative example 4 | 1 | >3.0 | 800 | 865 | 2.70 | 2.55 |
| | 2 | 3.0-0.5 | 900 | | 2.50 | |
| | 3 | <0.5 | 800 | | 2.50 | |
| Comparative example 5 | 1 | >3.0 | 850 | 840 | 2.60 | 2.44 |
| | 2 | 3.0-0.5 | 850 | | 2.40 | |
| | 3 | <0.5 | 750 | | 2.30 | |

The oxygen feeding rate from the top blowing lance and the lance height LH were changed in accordance with the different nozzles of the top blowing lance in such a manner that the oxygen gas flow velocity $v_{gc}$ at the collision surface of the hot metal surface was in the range of about 120 to 240 m/s in sections 1, 2, and 3. The flow rate of the bottom-blown gas was constant in all tests.

Table 5 presents the oxygen flow rate F per unit hot spot area calculated from Formula (1), the maximum value $S(F)_{max}$ of an oxygen accumulation index S(F) in the converter calculated from Formula (2), and operation results for each test.

TABLE 5

| | Section | Carbon concentration (% by mass) | Flow rate ($Nm^3/(m^3 \cdot s)$) Section | Flow rate ($Nm^3/(m^3 \cdot s)$) Average | $S(F)_{max}$ | Blowing time (min) | Index W of metal dropped to outside of converter (–) |
|---|---|---|---|---|---|---|---|
| Example 1 | 1 | >3.0 | 0.962 | 0.758 | 29.5 | 21.0 | 0.98 |
| | 2 | 3.0-0.5 | 0.668 | | | | |
| | 3 | <0.5 | 0.834 | | | | |
| Example 2 | 1 | >3.0 | 1.002 | 0.780 | 35.9 | 22.4 | 1.04 |
| | 2 | 3.0-0.5 | 0.669 | | | | |
| | 3 | <0.5 | 0.946 | | | | |
| Example 3 | 1 | >3.0 | 0.805 | 0.759 | 27.3 | 22.0 | 1.08 |
| | 2 | 3.0-0.5 | 0.734 | | | | |
| | 3 | <0.5 | 0.806 | | | | |
| Example 4 | 1 | >3.0 | 0.761 | 0.759 | 16.3 | 22.4 | 1.02 |
| | 2 | 3.0-0.5 | 0.703 | | | | |
| | 3 | <0.5 | 0.722 | | | | |
| Comparative example 1 | 1 | >3.0 | 0.870 | 0.762 | 43.9 | 21.1 | 1.78 |
| | 2 | 3.0-0.5 | 0.709 | | | | |
| | 3 | <0.5 | 0.831 | | | | |
| Comparative example 2 | 1 | >3.0 | 0.870 | 0.793 | 45.8 | 23.0 | 1.88 |
| | 2 | 3.0-0.5 | 0.825 | | | | |
| | 3 | <0.5 | 0.835 | | | | |
| Comparative example 3 | 1 | >3.0 | 1.056 | 0.798 | 41.7 | 22.7 | 1.45 |
| | 2 | 3.0-0.5 | 0.669 | | | | |
| | 3 | <0.5 | 0.994 | | | | |
| Comparative example 4 | 1 | >3.0 | 0.994 | 0.822 | 49.2 | 23.2 | 1.88 |
| | 2 | 3.0-0.5 | 0.744 | | | | |
| | 3 | <0.5 | 0.899 | | | | |
| Comparative example 5 | 1 | >3.0 | 0.855 | 0.808 | 42.8 | 23.3 | 1.77 |
| | 2 | 3.0-0.5 | 0.776 | | | | |
| | 3 | <0.5 | 0.900 | | | | |

As apparent from Table 5, the blowing time was almost equal between the examples and the comparative examples. However, the index W of metal dropped to outside of the converter in each of Examples 1 to 4 at the time of the completion of the blowing was significantly smaller than those in Comparative examples 1 to 5 at the time of the completion of the blowing. These results indicated that at an oxygen accumulation index S(F) of 40 or less, the adhesion of metal can be suppressed, so that the converter operation that can control a decrease in iron yield can be performed.

The invention claimed is:

1. A method for operating a converter, comprising:

a refining process including decarburizing molten iron in a converter with a top blowing lance having one or more Laval nozzles disposed at a lower end thereof by blowing oxygen gas on a surface of the molten iron in the converter through the one or more Laval nozzles, wherein:

an oxygen gas flow rate F per unit hot spot area ($Nm^3/(m^2 \times s)$) is determined by Formula (1) described below, an oxygen accumulation index S(F) in the converter is determined from the oxygen gas flow rate F and Formula (2) described below, and one or both of an oxygen feeding rate $Q_g$ from the top blowing lance and lance height LH are adjusted such that the oxygen accumulation index S(F) satisfies Formula (3) described below, $$F = \frac{\left(\frac{Q_g}{n}\right)^{1.2}}{\frac{\pi}{6} \times r \times \left[(r^2 + 4L)^{\frac{3}{2}} - r^3\right]} \times \left(\frac{4.8586 P_0^{0.112} \times d_c^{-0.44} \times v_{gc}}{1630}\right)^{0.2} \quad (1)$$

$$S(F) = \alpha \Sigma \left(\frac{1}{F_0} - \frac{1}{F}\right) \Delta t \quad (2)$$

$$S(F) \leq 40 \quad (3)$$

where in Formula (1), n is a number of the one or more Laval nozzles disposed at the lower end of the top blowing lance, $d_c$ is a throat diameter (mm) of each of the one or more Laval nozzles, $Q_g$ is the oxygen feeding rate ($Nm^3/s$) from the top blowing lance, $P_0$ is a supply pressure (Pa) of the oxygen gas to the one or more Laval nozzles, $v_{gc}$ is an oxygen gas flow velocity calculated from the lance height LH (m) at a collision surface of the surface of the molten iron and is the oxygen gas flow velocity (m/s) along a central axis of each of the one or more Laval nozzles, r is a radius (mm) of a cavity formed by colliding the oxygen gas with the surface of the molten iron, and L is a depth (mm) of the cavity, and where in Formula (2), $\alpha$ is a constant ($(m^2 \times s)/Nm^3$), $F_0$ is a constant ($Nm^3/(m^2 \times s)$), and $\Delta t$ is a data collection time interval (s).

2. The method for operating a converter according to claim 1, wherein:

an actual value of the oxygen accumulation index S(F) calculated from Formula (2) and an amount of unidentified oxygen are monitored during the blowing to determine the constant $\alpha$, the amount of unidentified oxygen is defined by a difference between an amount of oxygen input and an amount of oxygen output, the amount of oxygen input is defined by a sum of: (i) an amount of the oxygen gas supplied from the top blowing lance and (ii) an amount of oxygen in an auxiliary raw material charged into the converter, and the amount of oxygen output is defined by a sum of: (i) amounts of oxygen present as CO gas, $CO_2$ gas, and oxygen gas in an exhaust gas from the converter and (ii) an amount of oxygen consumed by a desiliconization reaction and present as $SiO_2$ in the converter.

* * * * *